US006637964B1

(12) United States Patent
Kuo

(10) Patent No.: US 6,637,964 B1
(45) Date of Patent: Oct. 28, 2003

(54) LIPSTICK CASE MADE OF PAPER

(76) Inventor: Chen-Hui Kuo, No. 191, Lu-Tung Road, Lu-Kang Township, Chang Hua Hsien (TW)

( * ) Notice: Subject to any disclaimer, the term of this patent is extended or adjusted under 35 U.S.C. 154(b) by 0 days.

(21) Appl. No.: 10/285,811

(22) Filed: Nov. 4, 2002

(51) Int. Cl.[7] ..... B43K 21/02
(52) U.S. Cl. ..... 401/55
(58) Field of Search ..... 401/55, 65, 68–72, 401/74, 75, 77, 78

(56) References Cited

U.S. PATENT DOCUMENTS 2,027,921 A * 1/1936 Marcus ..... 206/385
3,698,551 A * 10/1972 Tomlinson ..... 206/489
4,044,889 A * 8/1977 Orentreich et al. ..... 206/459.5
5,186,561 A * 2/1993 Ackermann et al. ..... 401/78
5,557,867 A * 9/1996 Sugawara ..... 40/493
6,068,421 A * 5/2000 Pierpont ..... 401/78
6,457,223 B1 * 10/2002 Breton et al. ..... 29/417

* cited by examiner

*Primary Examiner*—Gregory Huson
*Assistant Examiner*—Huyen Le
(74) *Attorney, Agent, or Firm*—Harrison & Egbert

(57) ABSTRACT

A lipstick case includes a base member and a cap member removably joined with the base member. The base member and the cap member are made of a paper material and are decorated with a pattern serving to enhance the appeal of the lipstick case.

2 Claims, 4 Drawing Sheets

LIPSTICK CASE MADE OF PAPER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lipstick, and more particularly to a lipstick case which is made of paper and can be therefore easily disposed of without causing environmental pollution.

BACKGROUND OF THE INVENTION

As shown in FIG. 1, the conventional lipstick case is formed of a tubular base 10 and a tubular cap 14, which are dimensioned to accommodate a lipstick 13 that is held by a lipstick tube 11 and a lipstick seat 12. The tubular base 10 and the tubular cap 14 of the conventional lipstick case are made of a plastic material, which can not be decomposed by nature and is therefore an environmental pollutant. In addition, the incineration of the conventional lipstick case produces harmful gases, which are discharged into the atmosphere. It is therefore readily apparent that the conventional lipstick case is undesirable in terms of environmental protection.

BRIEF SUMMARY OF THE INVENTION

The primary objective of the present invention is to provide a lipstick case which does not become a source of environmental pollution.

It is another objective of the present invention to provide a lipstick case which is so patterned as to enhance its esthetic effect.

In keeping with the principle of the present invention, the foregoing objective of the present invention are attained by a lipstick case which is made of a paper material and is formed of a base member and a cap member. The base member and the cap member are so constructed to house a lipstick holder. The lipstick case of the present invention can be easily disposed of by nature or incineration without polluting the environment.

The base member and the cap member of the lipstick case of the present invention are decorated with a pattern or design, so as to enhance the appeal of the present invention to the consumer at large.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
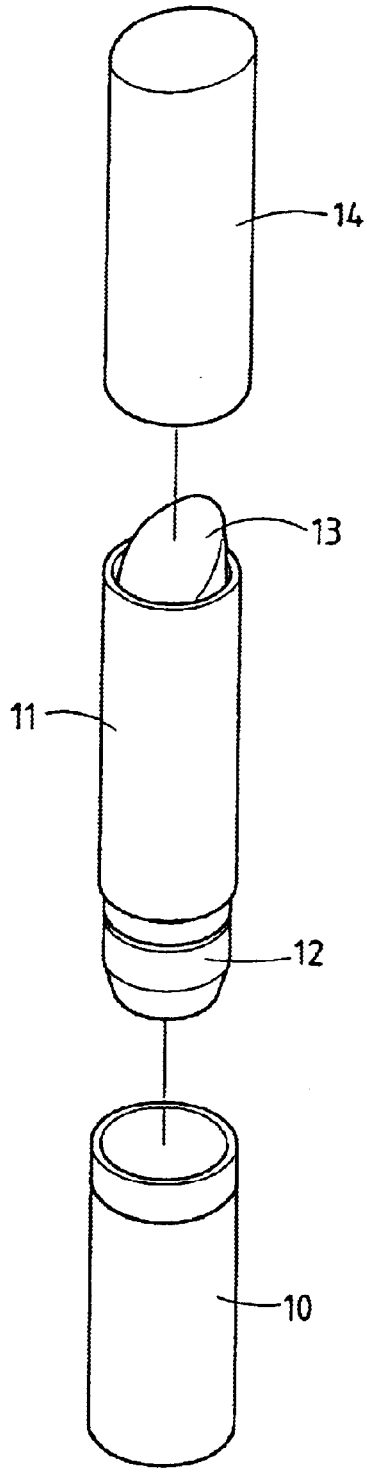
FIG.1 PRIOR ART
FIG. 1 shows an exploded perspective view of a lipstick case of the prior art.
Figure 2:
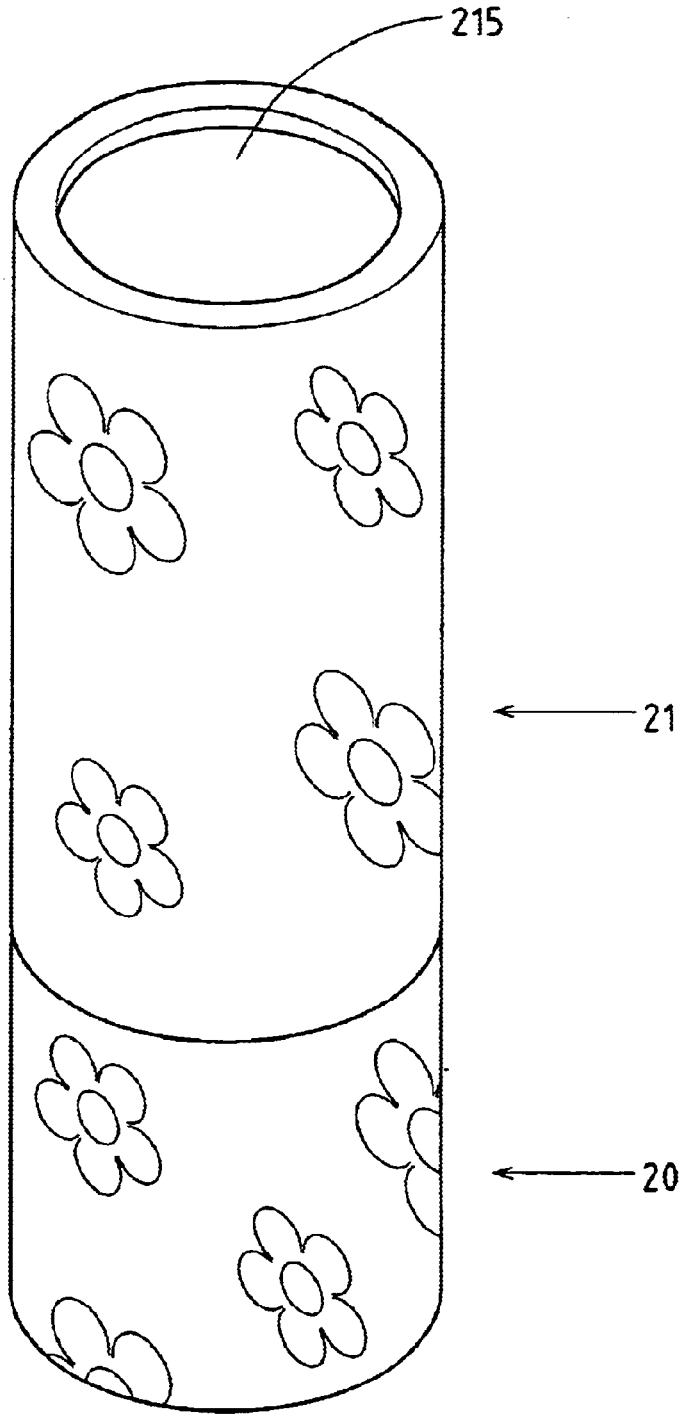
FIG. 2 shows a perspective view of the preferred embodiment of the present invention.
Figure 3:
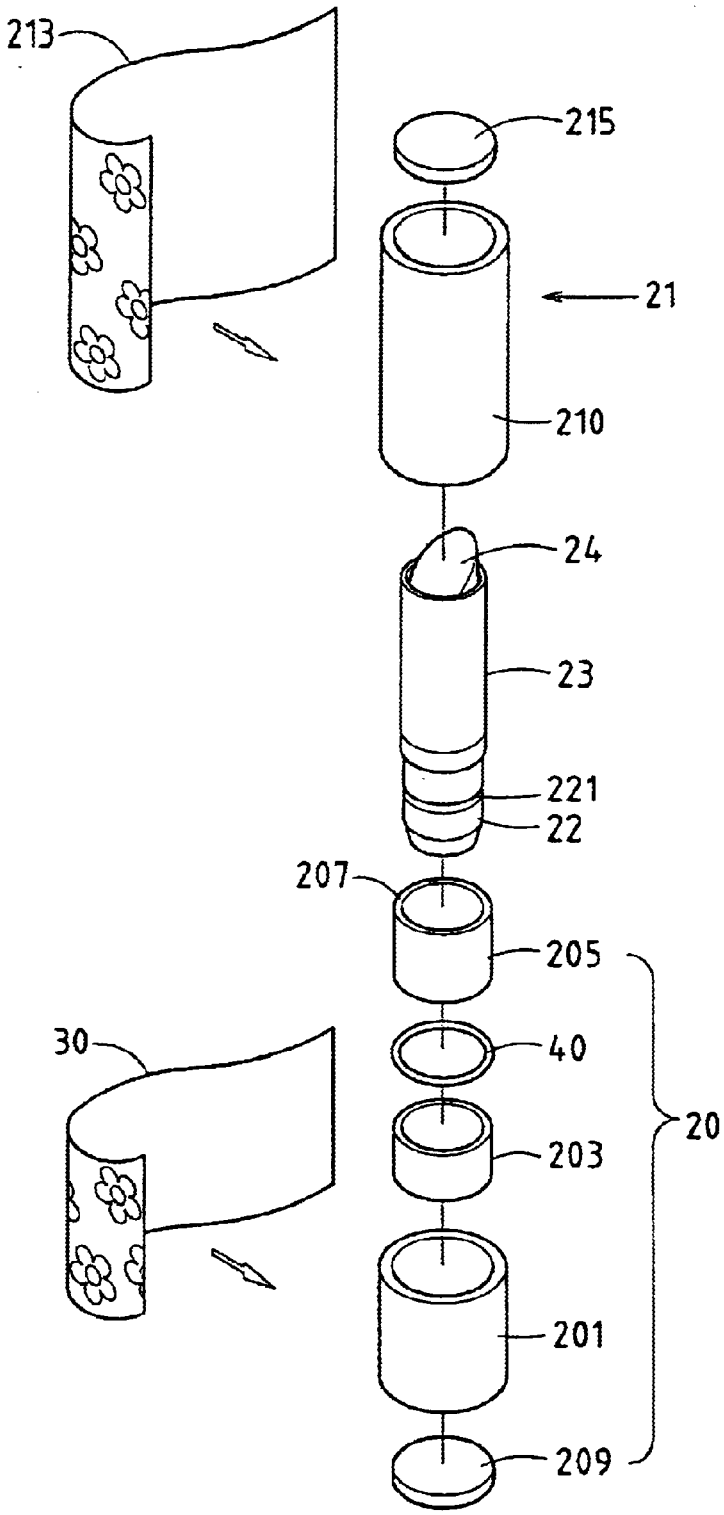
FIG. 3 shows an exploded perspective view of the preferred embodiment of the present invention.
Figure 4:
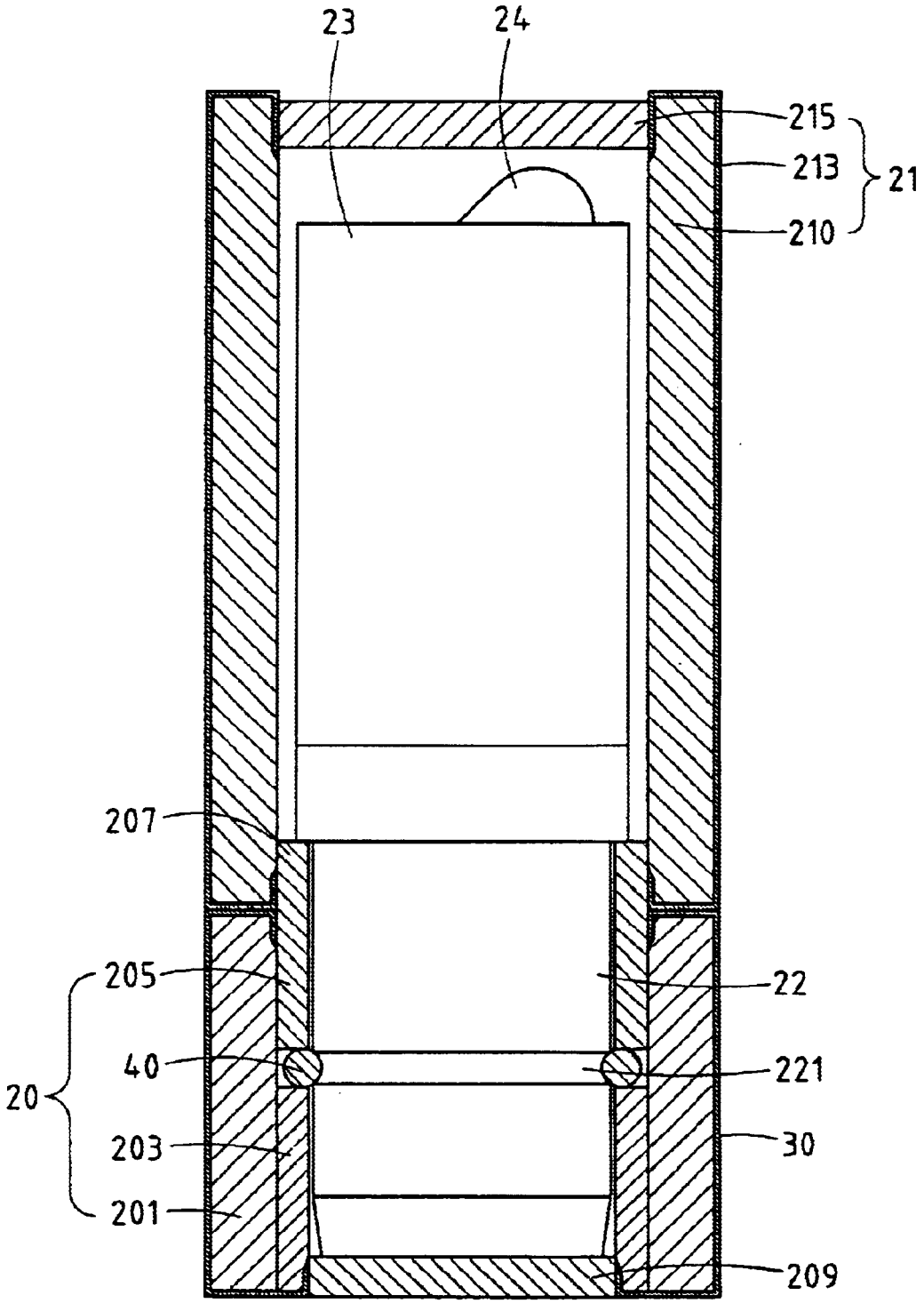
FIG. 4 shows a longitudinal sectional view of the preferred embodiment of the present invention.

As shown in FIGS. 2–4, a lipstick case embodied in the present invention comprises a base member 20 and a cap member 21.

The base member 20 is made of a paper material and is formed of an outer tubular body 201, a first inner tubular body 203, a second inner tubular body 205, and a seat 209. The seat 209 is joined with the bottom end of the outer tubular body 201. The first inner tubular body 203 is disposed in the outer tubular body 201 such that the bottom end of the first inner tubular body 203 embraces the seat 209, as shown in FIG. 4. The second inner tubular body 205 is disposed in the outer tubular body 201 in conjunction with a ring 40 which is located between the bottom end of the second inner tubular body 205 and the top end of the first tubular body 201. The second inner tubular body 205 is provided at the top end with an annular projection 207, which is jutted out of the top end of the outer tubular body 201.

The cap member 21 is made of a paper material and is formed of a tubular main body 210 and a cover plate 215 which is joined with the top end of the tubular main body 210.

The case of the present invention is used to house a lipstick holder 23 such that a bottom end 22 of the lipstick holder 23 is located securely on the seat 209 of the outer tubular body 201, and that the ring 40 is retained in an outer retaining groove 221 of the bottom end 22 of the lipstick holder 23. A lipstick 24 is movably retained in the lipstick holder 23.

The base member 20 is provided in the external surface with a patterned piece 30 attached thereto. The patterned piece 30 is made of paper and is intended to enhance the esthetic effect of the base member 20. The cap member 21 is similarly provided in the external surface with a patterned piece 213 attached thereto. The patterned piece 213 is made of paper and is used to enhance the esthetic effect of the cap member 21.

In light of the lipstick case of the present invention being made of paper material, the present invention can be easily disposed of by nature or incineration, without producing anything detrimental to the environment.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A lipstick case comprising:

a base member of a hollow tubular construction, said base member comprising:

an outer tubular body;

a first inner tubular body positioned in a lower portion of said outer tubular body;

a seat embraced by a bottom end of said first inner tubular body;

a second inner tubular body positioned in said outer tubular body so as to have an upper end extending outwardly of an upper end of said outer tubular body; and a ring means positioned between an upper end of said first inner tubular body and a lower end of said second inner tubular body, said ring means for retaining a bottom end of a lipstick holder; and a cap member of a hollow tubular construction, said cap member having an interior area suitable for covering the lipstick holder, said cap member extending over and around said upper end of said second inner tubular body and removably joined with a top end of said base member, said base member and said cap member being formed of a paper material.

2. The lipstick case of claim 1, further comprising:

a first patterned piece of paper material attached to an external surface of said base member; and a second patterned piece of paper material attached to an external surface of said cap member.

* * * * *